United States Patent [19]

Heil

[11] 4,370,762

[45] Feb. 1, 1983

[54] PORTABLE ATTACHMENT FOR SINKS

[75] Inventor: John Heil, Dayton, Ohio

[73] Assignee: Allcraft Plastic Company, Inc., Dayton, Ohio

[21] Appl. No.: 243,525

[22] Filed: Mar. 13, 1981

[51] Int. Cl.[3] ..... E03C 1/24

[52] U.S. Cl. ..... 4/206; 4/201; 4/191

[58] Field of Search ..... 4/201, 206, 191, 256, 4/198, 199, 200; 210/169; 137/362, 593

[56] References Cited

U.S. PATENT DOCUMENTS

| | | | |
|---|---|---|---|
| 740,737 | 10/1903 | Blum | 4/206 |
| 2,065,347 | 12/1936 | Schulse | 4/201 |
| 2,321,176 | 6/1943 | Bloch | 4/206 |
| 2,374,642 | 5/1945 | Bloch | 4/206 |
| 2,884,650 | 5/1959 | Cooper | 4/206 |
| 3,070,812 | 1/1963 | Skrmetta | 4/206 |
| 3,289,218 | 12/1966 | Mehilos | 4/206 |
| 3,616,923 | 11/1971 | Haley | 4/510 X |
| 3,922,733 | 12/1975 | Lyon et al. | 4/191 |
| 4,077,430 | 3/1978 | Brown | 4/206 X |
| 4,135,260 | 1/1979 | Gresh | 4/206 X |

*Primary Examiner*—Henry K. Artis

*Attorney, Agent, or Firm*—Becker & Becker, Inc.

[57] ABSTRACT

A portable sink attachment comprising a hollow elbow-shaped member having an opening at either end. The opening at the upper end is adapted to receive the hollow extension projecting from the bottom of a curved receptacle having a wide mouth and tapering down to this extension. The lower end of the elbow-shaped member is connected to a sealing member which is provided with a seat and a vertically descending section. The vertically descending section fits snugly within the opening of a gasket which is attached to the sealing member, with the gasket resting firmly against the seat provided on the sealing member.

3 Claims, 3 Drawing Figures

PORTABLE ATTACHMENT FOR SINKS

The present invention relates to improvements in attachments for sinks. This invention allows for liquid disposal while the sink is in use and the drain is therefore blocked.

It has been a problem with single kitchen sinks that, once the drain has been closed to allow dishwashing or other use of the sink, there is no way to dispose of liquids which may have been forgotten prior to blocking the drain. It is then necessary to open the drain, release the dishwater, dispose of the liquid, close the drain, and then refill the sink. In terms of both time and aggravation, it is desirable to avoid the necessity for doing this.

Devices are known to avoid this problem. For example, glass-shaped (U.S. Pat. No. 2,065,347-Schulse) and funnel-like (U.S. Pat. No. 3,289,218-Mehilos) receptacles have been inserted into the drain in direct vertical relation to the drain. A drawback of this known method, however, is that it makes a certain amount of space in the area of the drain unusable. Since the drain is usually near the center of a kitchen sink, this makes a major portion of the sink virtually unusable. Also, elbow-shaped, jointed ducts (U.S. Pat. No. 3,922,733-Lyon et al) have been used as a sink overflow control device. Because it was intended to be an overflow device, the size of the opening for receiving the liquid made it difficult to use it as a liquid disposal. Additionally, the end fitting into the drain was bulky and space consuming, taking away space that could have been used for dishwashing, etc. It also created an extremely uneven bottom surface in the sink. Another disadvantage was that it had to be anchored to a side of the sink.

It is therefore an object of the present invention to provide a sink attachment which can serve to dispose of liquids and control water overflow while the sink drain is closed.

It is a further object of the invention to do this using a minimum of space so as to leave as much sink space as possible available for other use.

It is also an object of the present invention to provide a watertight drain seal whose construction is such that it is not awkward and bulky, that it leaves the bottom surface of the sink relatively flat, and that it does not have to be anchored to the sink.

These and other objects and advantages of the present invention will appear more clearly from the following specification in connection with the accompanying drawing, in which.

Figure 1:
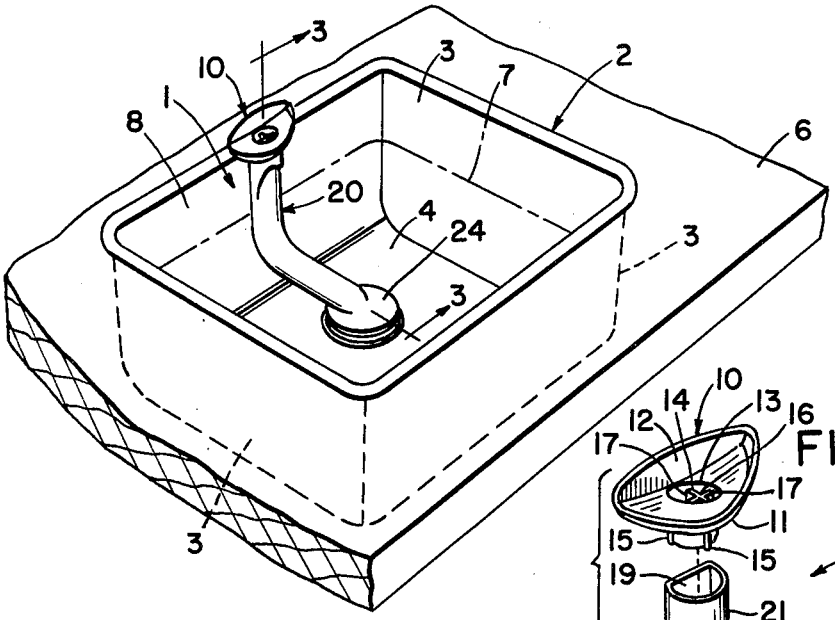
FIG. 1 shows an isometric view of the sink attachment, according to the invention, placed in a sink.

The invention is characterized primarily by a hollow elbow-shaped member provided with an opening at each end. The elbow-shaped member is of a comparatively flat construction which expands, on the one end, to receive a curved receptacle and, on the other end, connects to a sealing member. The curved receptacle has a wide mouth and curving sides which taper down to a hollow extension that is received in the upper end of the elbow-shaped member. Four vertical planes forming a grid may be located in the interior of the extension. The sealing means is provided with a seat and a vertically descending section. The vertically descending section fits snugly within the opening of a gasket which is attached to the sealing member, with the gasket resting firmly against the seat provided on the sealing member. The gasket is a continuous piece, with the upper circumference being smaller than its lower circumference. The piece is folded over to form two walls of unequal height, and one wall slants slightly outwardly to form a recess between the two walls. This recess works to provide a secure, watertight seal when the attachment is placed in the drain.

Referring now to the drawing in detail, the portable sink attachment 1 is shown placed in a conventional type kitchen sink 2 having walls 3, an integral bottom 4, and a drain 5 located in the bottom portion 4. The sink 2 and drain 5 arrangement is shown in a conventional countertop 6, all of which are generally well known in the art. A usual water level line 7 is also shown to provide a complete view of the sink attachment in use.

The main portion 20 of the sink attachment 1 rests approximately against one of the walls 3 of the sink 2. FIG. 1 shows the main portion 20 resting against the back wall 8 of the sink 2, but it could easily be turned to rest against either of the other three walls 3. The bottom portion or sealing member 24 of the sink attachment 1 fastens or sits securely in the drain 5 located in the bottom 4 of the sink 2.

Figure 2:
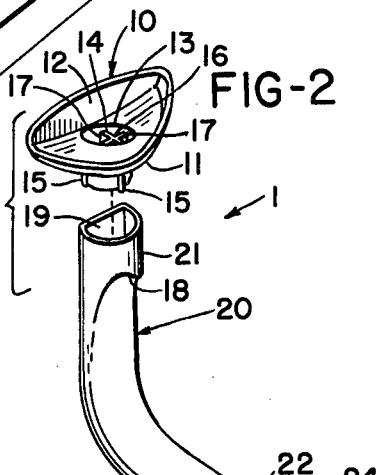
FIG. 2 is an exploded view showing the parts of the invention.

As shown in FIG. 2, the main portion 20 of the sink attachment 1 is an elbow-shaped section or member, which is roughly shaped to fit the contours of a sink so as to be as out of the way as possible. This allows the maximum amount of sink space to remain free for dishwashing, etc. The embodiment shown has a main portion 20 that is relatively flat, but it may also have a circular or some other shape. The main portion 20 has a first end 21 and a second end 22. Also, its interior is hollow to allow liquid and small particles (of food, for example) to flow therethrough.

The main portion 20 tapers outwardly toward the first end 21 until the point 18, where it increases to the size of the opening 19 which is of sufficient size to receive the top portion 10. This top portion 10 is an irregularly shaped receptacle having curved sides 11 which form a wide mouth and a hollow interior 12, and which taper or slope down to an opening 13 which is located in the bottom of the receptacle 10. The preferred embodiment is roughly triangular in shape, but could also be circular, rectangular, etc. The receptacle 10 is shown as a separate detachable part, but it could also be part of a single piece including the main body 20.

At the point of the opening 13, a hollow extension 14 is joined to the receptacle 10. Its shape corresponds to that of the first end 21 so that the extension 14 may be inserted therein. Accordingly, its size is slightly smaller than that of the first end 21. The distance between the opening 19 and the point 18 is at least the length of the extension 14, but preferably somewhat longer.

Located on the outside surface of the extension 14 are small ridges 15. These ridges are placed so as to allow an empty space between each neighboring ridge. When the extension 14 is inserted into the first end 21, these ridges 15 fit snugly against the inside surface of the first end 21. The space between these ridges, where the extension 14 does not touch the first end 21, works as an overflow device. When the water, or other liquid, level reaches the height of the opening 19, it flows into the spaces between the ridges and thereby enters the elbow shaped member 20 and flows away. This allows a certain water level to be maintained in the sink without the danger of overflowing.

Located inside the interior of the extension 14 are four vertical planes 17 which intersect at a point 16 in the center of the extension 14. The non-intersecting ends are attached to the interior walls of the extension 14. These planes 17 form a rough grid or screen to prevent any relatively large particles of food, etc. from entering the hollow main body 20 and clogging it. The grid size and configuration may be varied depending on the size of the particles which are to be kept from entering the main body 20. The grid 17 also serves the purpose of reinforcing the extension 14.

The second end 22 also forms an opening 23 (see FIG. 3), but the construction of the sink attachment continues so as to form the sealing member 24. The sealing member 24 is depicted as circular in order to adapt to a conventional sink drain, but its size and shape may vary according to the type of drain with which it will be used. The sealing member 24 has a downwardly substantially cylindrical exterior 26 which is designed to receive the gasket 30. The cylindrical exterior 26 has a slightly smaller diameter than does the sealing member 24, thereby providing a seat 25 for the gasket 30. The cylindrical exterior 26 fits tightly inside the opening 28 of the gasket 30, and the upper edge 27 of the gasket fits firmly against the seat 25.

The gasket 30 can be manufactured of rubber or any other suitable material which is flexible yet sturdy and durable. The gasket 30 is one continuous piece of a relatively small thickness (sufficient to approximately fill the seat 25), and is bent or folded over at 29 to form two walls 31 and 32. The circumference of the upper edge 27 of the gasket 30 is less than the circumference of its lower edge 34. When the gasket piece is folded up at 29, the wall 32 is of a shorter height than the wall 31 and slants somewhat outwardly in relation to the wall 31 so as to form a recess 33 between the walls 31 and 32. As a result, when the gasket 30 is inserted into the drain opening and is pushed down to close the drain, the walls 31 and 32 are pressed against each other, either reducing or entirely eliminating the space in the recess 33, thereby providing a firm and watertight seal.

The main portion 20 and the receptacle 10 may be manufactured of acrylonitrile-butadiene, or other plastic material such as high-impact styrene, or any other suitable material.

Figure 3:
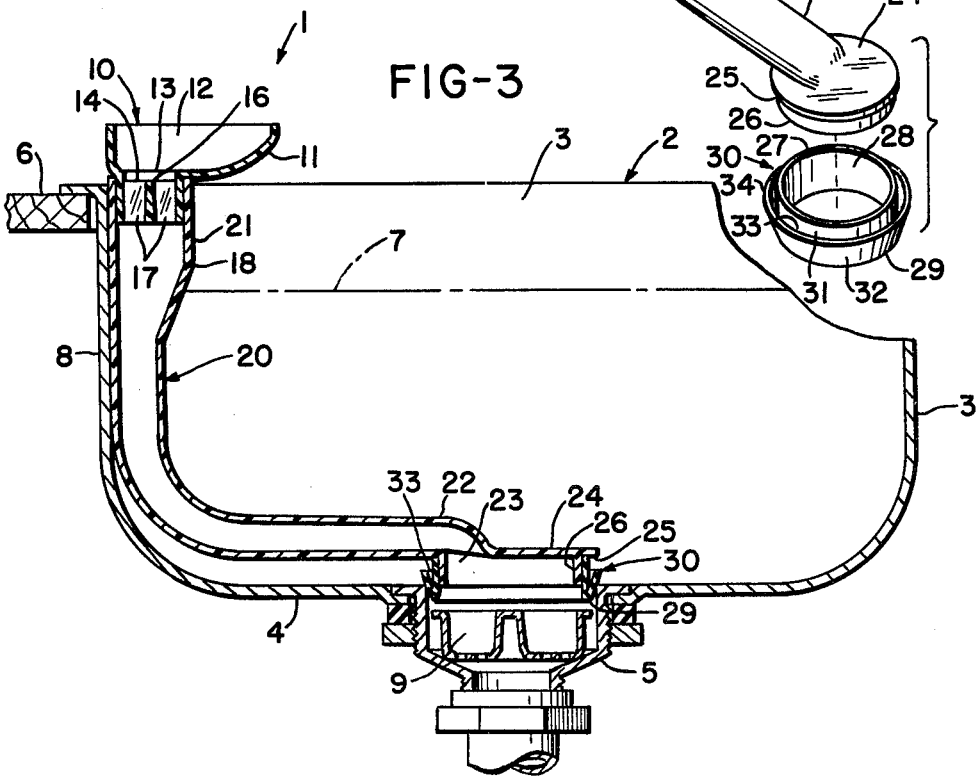
FIG. 3 is a vertical section taken along line 3—3 of FIG. 1.

FIG. 3 shows the sink attachment 1 placed in the sink. When the sealing member 24 has been pushed into the drain 5, thereby sealing the sink, the main member 20 will rest against a wall 8 and the bottom portion 4 of the sink 2. The receptacle 11 is then lowered to a position preferably below the top edge of the sink 2, thereby allowing the sink attachment 1 to also act as an overflow prevention device. The main portion 20 may therefore be made in varying lengths, thereby varying the height of the opening 19 at which point the water overflows into the main portion 20. The exact height is determined by the level of water which one desires to maintain in the sink by using this overflow feature of the invention. The main section 20 may also be lengthened so as to allow the receptacle 11 to rest at a position above the top edge of the sink 2. Additionally, should there be no disposal system or drain guard or strainer to catch food particles, a drain strainer 9 (as shown in FIG. 3) may be added. It can be constructed out of a material such as that used for the receptacle and main body. If the sink already has a drain strainer, it may be used, since the sealing action of the gasket 30 will not interfere with its normal use.

The present invention is, of course, in no way limited to the specific disclosure of the specification and drawing, but also encompasses any modifications within the scope of the appended claims.

What I claim is:

1. A sink attachment for use in a sink having a drain, said attachment comprising:

an elbow-shaped member having a first end and a second end, said elbow-shaped member having a hollow interior open at said first and second ends;

a receptacle having a wide mouth which tapers down to a hollow extension which is shaped to be received in said first end; and sealing means associated with said second end for providing a sealing engagement between said sink atachment and said sink drain, said sealing means including a sealing member having a downwardly directed substantially cylindrical portion, and a gasket received around said cylindrical portion, said gasket being a continuous hollow piece having a first end and a second end, said second end having a larger circumference than said first end, with said piece folding over itself to provide two walls of unequal height having a recess therebetween, with said first end engaging said cylindrical portion of said sealing member.

2. A sink attachment according to claim 1, in which said hollow extension of said receptacle is provided with four vertical planes having first ends which intersect in the middle of said extension and second ends which are attached to said extension.

3. A sink attachment according to claim 1, in which small ridges are provided on an exterior surface of said hollow extension, said ridges being spaced apart from one another.

* * * * *